US010054042B2

(12) United States Patent
Lavender et al.

(10) Patent No.: US 10,054,042 B2
(45) Date of Patent: Aug. 21, 2018

(54) ENGINE ASSEMBLY WITH AN ENGINE COVER OR HOUSING COMPRISING A BOSS

(71) Applicant: Ford Global Technologies, LLC, Dearborn, MI (US)

(72) Inventors: Joseph Lavender, Whitstable (GB); David Harknett, Rochford (GB); Dominic T. Evans, Sevenoaks (GB); Mark Michel, Dartford (GB); Wesley Shepherd, London (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/348,755

(22) Filed: Nov. 10, 2016

(65) Prior Publication Data

US 2017/0138256 A1 May 18, 2017

(30) Foreign Application Priority Data

Nov. 16, 2015 (GB) ..... 1520154.4

(51) Int. Cl.
*F02B 77/00* (2006.01)
*F02B 77/08* (2006.01)
(Continued)

(52) U.S. Cl.
CPC ..... *F02B 77/081* (2013.01); *F02B 77/11* (2013.01); *F02F 7/00* (2013.01); *F02F 2007/0078* (2013.01)

(58) Field of Classification Search
CPC . F02B 77/081; F02B 77/11; F02F 7/00; F02F 2007/0078; F02F 2007/0075;
(Continued)

(56) References Cited

U.S. PATENT DOCUMENTS 4,269,287 A 5/1981 Rösch
6,453,892 B1 9/2002 Plunkett et al.
6,766,714 B2 * 7/2004 Iwata ..... F02F 7/00 74/606 R

FOREIGN PATENT DOCUMENTS

CA 2553143 A1 5/2001
EP 1160438 A2 5/2001

OTHER PUBLICATIONS

Examination Report of Great Britain Patent Application No. 1520154.5, dated May 3, 2016, United Kingdom Intellectual Property Office, 6 pages.

* cited by examiner

*Primary Examiner* — Hung Q Nguyen
(74) *Attorney, Agent, or Firm* — Julia Voutyras; McCoy Russell LLP

(57) ABSTRACT

An engine assembly is provided, the engine assembly comprising an engine cover configured to cover a portion of an engine housing. The engine cover comprises: a coupling region provided around a periphery of at least a portion of the engine cover, the coupling region configured to mate with a corresponding coupling region on the engine housing so as to form a seal between the engine cover and the engine housing, and an engine cover boss provided on a planar region of the engine cover and spaced apart from the coupling region, the engine cover boss comprising a contact surface configured to receive an adhesive to couple the engine cover to a corresponding contact surface of the engine housing.

18 Claims, 5 Drawing Sheets

(51) Int. Cl.
*F02B 77/11* (2006.01)
*F02F 7/00* (2006.01)

(58) Field of Classification Search
CPC ..... F02F 7/0065; F02F 7/0068; F02F 7/0073;
F16M 1/00; F16M 1/02; F16M 1/026
See application file for complete search history.

ENGINE ASSEMBLY WITH AN ENGINE COVER OR HOUSING COMPRISING A BOSS

CROSS REFERENCE TO RELATED APPLICATION

The present application claims priority to Great Britain Patent Application No. 1520154.4, filed on Nov. 16, 2015. The entire contents of the above-referenced application are hereby incorporated by reference in its entirety for all purposes.

FIELD

The present disclosure relates to an engine assembly comprising an engine cover and an engine housing, and is particularly, although not exclusively, concerned with an engine assembly comprising a boss coupled to a planar region of the engine cover.

BACKGROUND/SUMMARY

An engine cover is often provided to enclose a cavity of an engine whilst allowing access to engine systems within the cavity, e.g. for service and maintenance. The cover is often securely coupled to the engine to create a seal between the engine housing and the cover. Sealing the cover over the cavity may prevent dust and other contaminants entering the cavity and may also prevent any engine oil present within the cavity from leaking out of the engine. During use of the engine, engine vibrations may excite vibration modes of the cover.

Vibration of the cover may have a detrimental effect on the sealing between the cover and the engine housing, leading to dust and other contaminants entering the cavity. Vibration of the cover may also create undesirable noise.

According to an aspect of the present disclosure, there is provided an engine assembly comprising an engine cover configured to cover a portion of an engine housing, wherein the engine cover comprises: a coupling region provided around a periphery of at least a portion of the engine cover, the coupling region configured to mate with a corresponding coupling region on the engine housing so as to form a seal between the engine cover and the engine housing; and an engine cover boss provided on a planar region of the engine cover and spaced apart from the coupling region, the engine cover boss comprising a contact surface configured to receive an adhesive to couple the engine cover to a corresponding contact surface of the engine housing. The engine cover further comprises an engine mount spaced apart from the planar region of the cover. The coupling between the cover and the engine housing at the contact surface is configured, e.g. the contact surfaces may be positioned, to increase the rigidity of the cover between the engine mount and the engine housing.

The planar region may comprise a flat or curved panel. The planar region may be free of structural reinforcement.

The engine assembly may further comprise the engine housing. The engine housing may further comprise a housing boss. The corresponding contact surface of the engine housing may be provided on the housing boss.

According to another aspect of the present disclosure, there is provided an engine assembly comprising an engine cover and an engine housing configured to be partially covered by the engine cover, wherein the engine housing comprises: a coupling region configured to mate with a corresponding coupling region provided around the periphery of at least a portion of the engine cover; and a housing boss spaced apart from the engine housing coupling region, wherein the housing boss comprises a contact surface configured to receive an adhesive to couple the engine housing to a corresponding contact surface on a planar region of the engine cover. The engine cover comprises an engine mount spaced apart from the planar region of the cover. The coupling between the cover and the engine housing at the contact surface is configured, e.g. the contact surfaces may be positioned, to increase the rigidity of the cover between the engine mount and the engine housing.

The engine cover may comprise an engine cover boss. The corresponding contact surface of the engine cover may be provided on the engine cover boss.

The coupling between the engine cover and the engine housing at the contact surface may be configured to damp a vibration mode of the engine cover. For example, a damping material may be provided between the engine cover and the engine housing at the contact surface.

The shape and/or position of the engine cover boss may be configured such that the engine cover boss is provided outside a keep-out zone of a packaging constraint of the engine.

The engine assembly may further comprise a drive assembly, such as a belt drive, chain drive and/or gear drive. The engine cover may be configured to at least partially surround the drive assembly. The shape and/or position of the engine cover boss may be configured such that the engine cover boss is provided outside a keep-out zone of the drive assembly. Additionally or alternatively, the shape and/or position of the housing boss may be configured such that the housing boss is provided outside a keep-out zone of the drive assembly. The engine cover boss and/or the housing boss may be provided between belt portions, e.g. the engine cover boss and/or the housing boss may be provided inside the perimeter of the belt.

The shape of at least part of the engine cover boss and/or the housing boss may follow, e.g. be defined by, the shape of the keep-out zone.

The adhesive may comprise an engine sealant. The engine sealant may be applied to the coupling region or corresponding coupling region to improve the sealing between the engine housing and the engine cover. The contact surface may be sized according to a shear strength of the adhesive. Additionally or alternatively the contact surface may be sized according to a vibration damping characteristic of the adhesive, e.g. according to a viscosity of the adhesive.

The engine cover may be a front engine cover. The engine housing may comprise an engine cylinder head and/or an engine cylinder block.

The coupling between the engine cover and the engine housing at the contact surface and corresponding contact surface may be configured to improve a noise, vibration and/or harshness characteristic of the engine cover.

According to another aspect of the present disclosure, there is provided a method of assembling an engine assembly, the method comprising:

providing an engine housing;

providing an engine cover configured to cover a portion of the engine housing, wherein the engine cover comprises:

a coupling region provided around a periphery of at least a portion of the engine cover, the coupling region configured to mate with a corresponding coupling region on the engine housing so as to form a seal between the engine cover and the engine housing;

an engine cover boss provided on a planar region of the engine cover and spaced apart from the coupling region, the engine cover boss comprising a contact surface configured to mate with a corresponding contact surface on the engine housing; and an engine mount spaced apart from the planar region of the cover;

applying an adhesive to the contact surface or corresponding contact surface; and coupling the engine cover to the engine housing using the adhesive, wherein the coupling between the cover and the engine housing at the contact surface is configured to increase the rigidity of the cover between the engine mount and the engine housing.

According to another aspect of the present disclosure, there is provided a method of assembling an engine assembly, wherein the method comprises:

providing an engine cover and an engine housing configured to be partially covered by the engine cover, wherein the engine housing comprises:

a coupling region configured to mate with a corresponding coupling region provided around the periphery of at least a portion of the engine cover; and a housing boss spaced apart from the engine housing coupling region, wherein the housing boss comprises a contact surface configured to mate with a corresponding contact surface on a planar region of the engine cover;

providing the engine cover, wherein the engine cover comprises an engine mount spaced apart from the planar region of the cover;

applying an adhesive to the contact surface or corresponding contact surface; and coupling the engine cover to the engine housing using the adhesive, wherein the coupling between the cover and the engine housing at the contact surface is configured to increase the rigidity of the cover between the engine mount and the engine housing.

The adhesive may comprise an engine sealant. The method may further comprise applying the engine sealant to the coupling region and/or corresponding coupling region to improve the sealing between the engine housing and the engine cover. The engine sealant may be applied to the coupling region and/or corresponding coupling region and the contact surface and/or corresponding contact surface in the same application operation.

According to another aspect of the present disclosure, there is provided a vehicle, e.g. a motor vehicle, comprising the engine assembly according to a previously mentioned aspect of the disclosure.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the disclosure may also be used with any other aspect or embodiment of the disclosure within the scope of the claims below.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1:
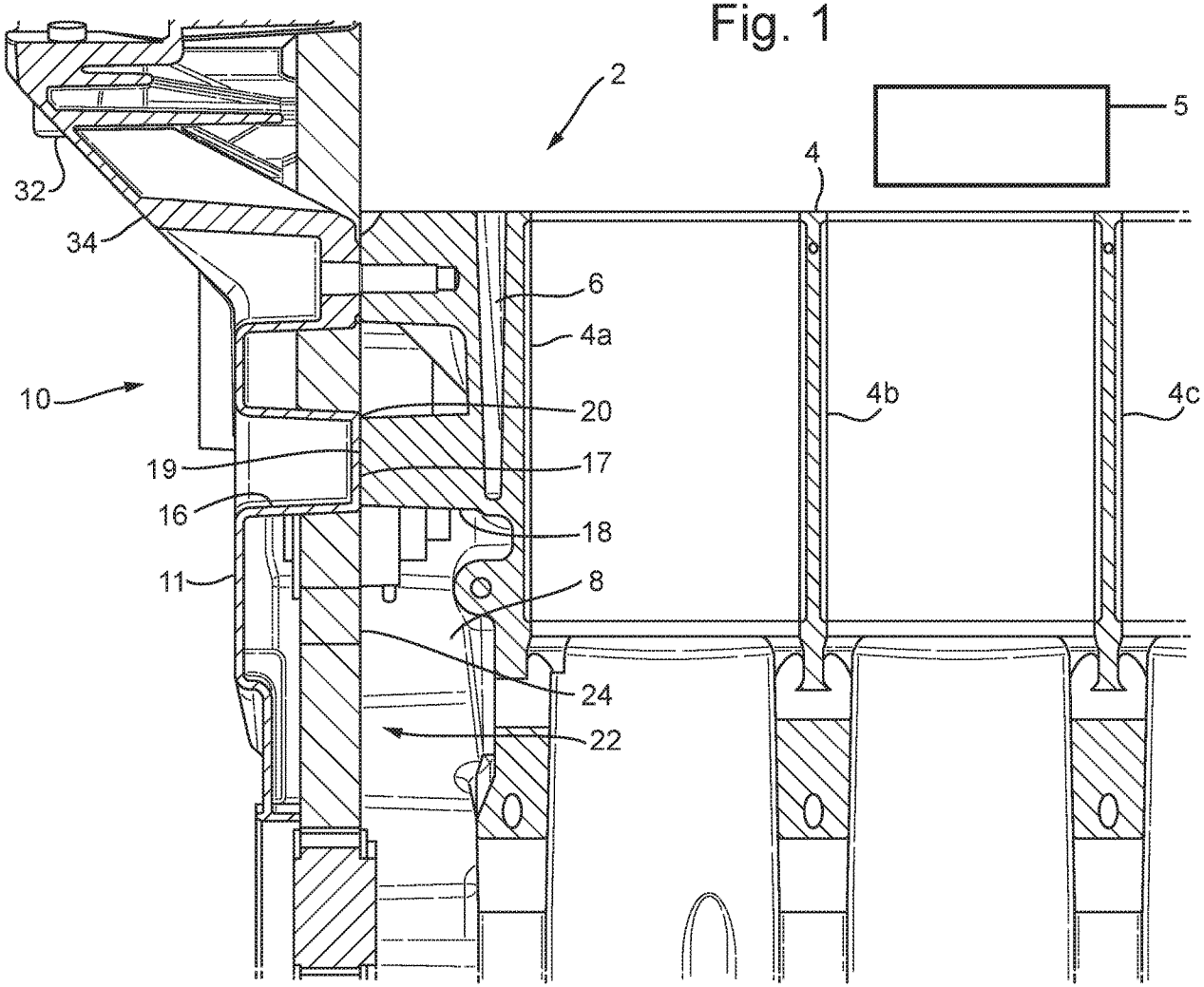
FIG. 1 is a partial side sectional view of an engine assembly according to an arrangement of the present disclosure.

With reference to FIG. 1, an engine assembly 2, according to an arrangement of the present disclosure, may comprise an engine housing formed from one or more engine housing portions, such as an engine cylinder block 4 and a cylinder head 5. The engine assembly may further comprise an engine cover, such as a front cover 10.

The cylinder block 4 may define one or more cylinders 4*a*, 4*b*, 4*c*. The cylinder block may comprise a coolant chamber 6, which form part of a cooling circuit configured to circulate engine coolant around each of the cylinders 4*a*, 4*b*, 4*c*, to cool the cylinders.

The cylinder block 4 may at least partially define an engine cavity 8. For example a side of the engine housing may define a side, e.g. a wall, of the cavity 8. As shown in FIG. 1, a front engine cavity 8 may be partially defined by a front wall of the engine housing.

The front cover 10 may be configured to couple to the engine housing and may be configured to cover a portion of the engine housing. As shown in FIG. 1, the front cover 10 may at least partially define the engine cavity 8, e.g. the front cover 10 may define a further wall of the engine cavity 8. The cavity 8 may be defined between the cylinder block 4 and the front cover 10.

In order to seal the cavity 8, e.g. to prevent any dust, contaminants and/or other substances entering and/or escaping the cavity 8, the front cover 10 may comprise a coupling and sealing region 12. The coupling and sealing region 12 may be configured to mate with a corresponding coupling and sealing region 14 provided on the engine housing 4. The engine cover and engine housing may be coupled together so as to form a seal between the components.

The coupling and sealing region 12 may extend around at least a portion of the front cover, e.g. a portion that defines a wall of the cavity 8. The coupling and sealing region 12 may extend substantially around, or may substantially define, a perimeter of the front cover 10; however, it will be appreciated that portions of the front cover may extend outside the perimeter defined by the coupling and sealing region 12.

Figure 2:
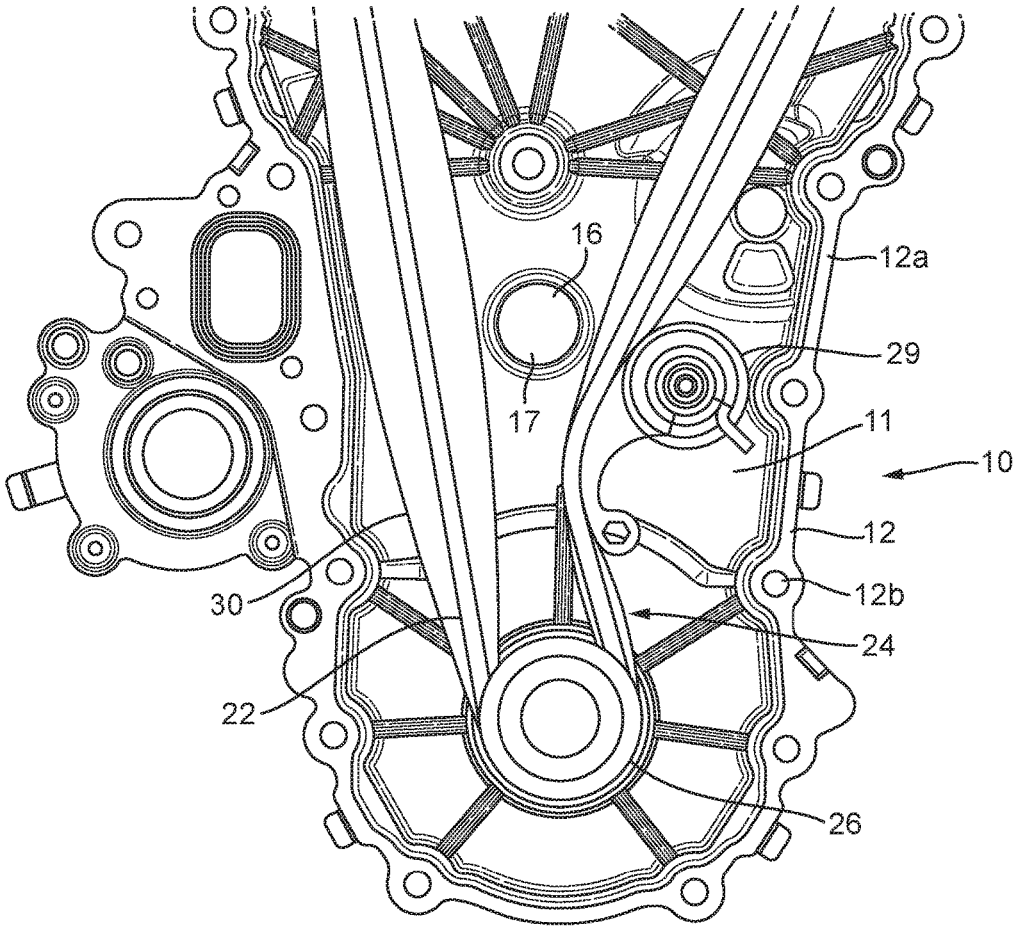
FIG. 2 is a partial rear view of an engine cover according to an arrangement of the present disclosure.
Figure 3:
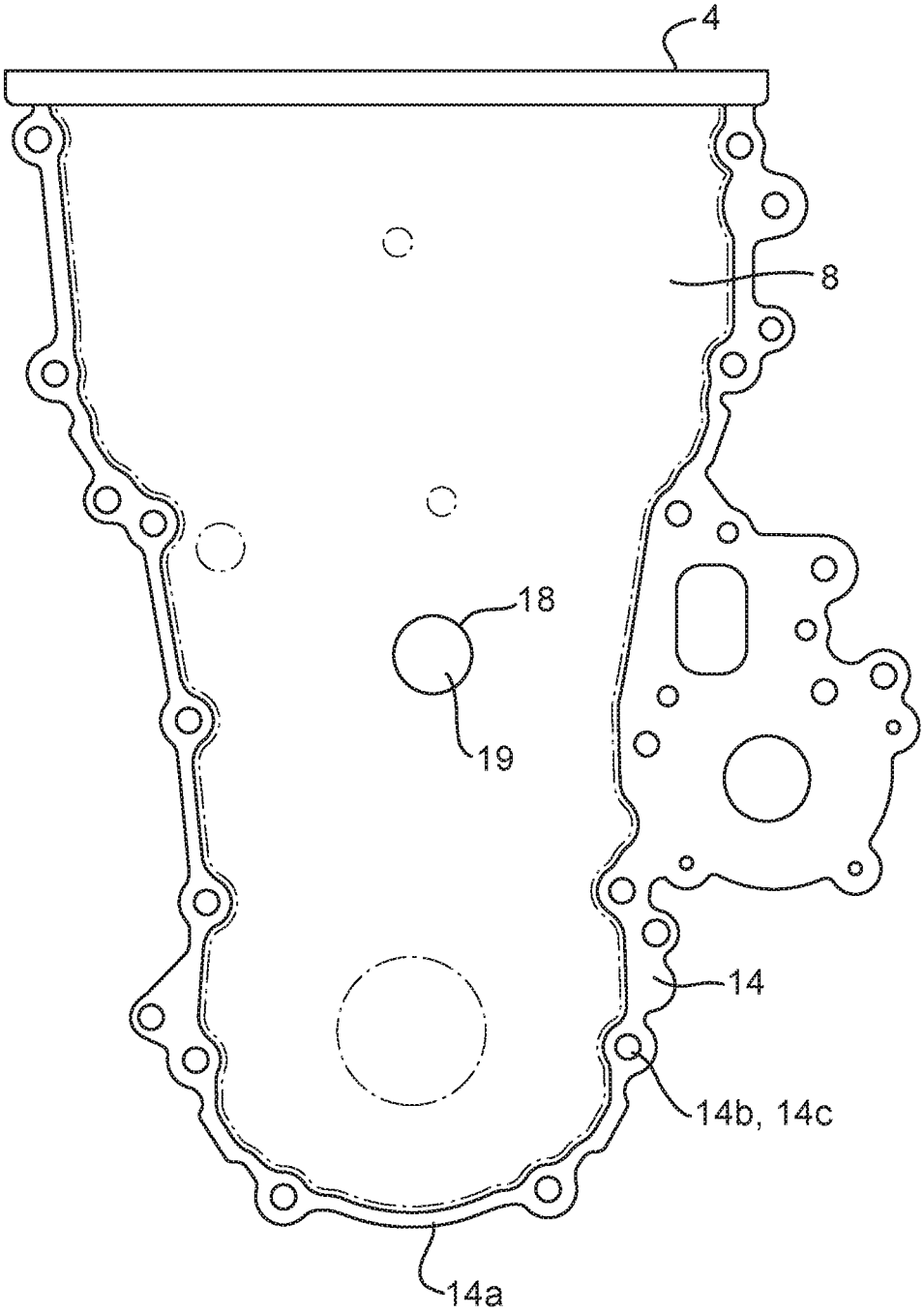
FIG. 3 is a front view of an engine housing according to an arrangement of the present disclosure.
Figure 4:
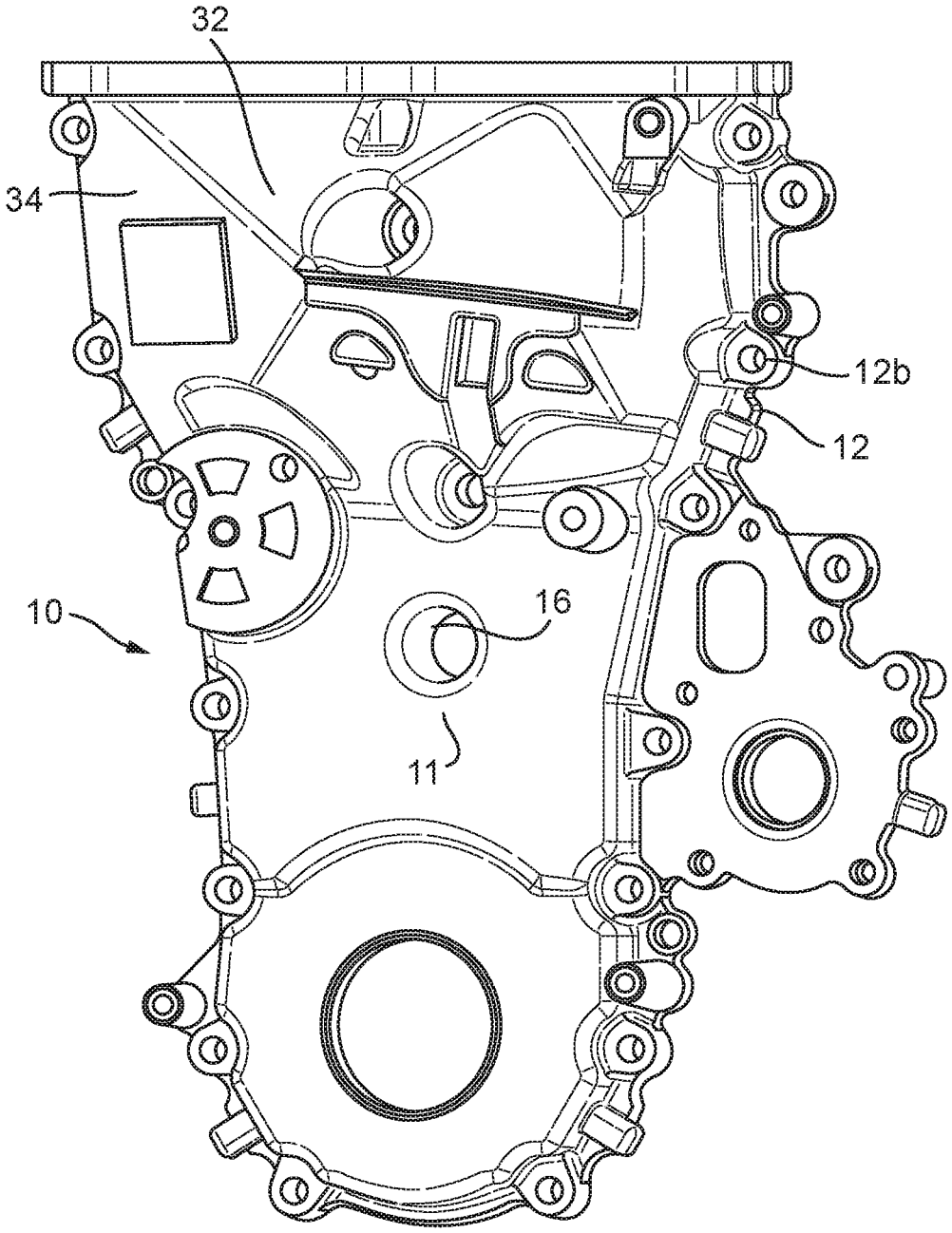
FIG. 4 is a front view of a front engine cover according to an arrangement of the present disclosure.
Figure 5:
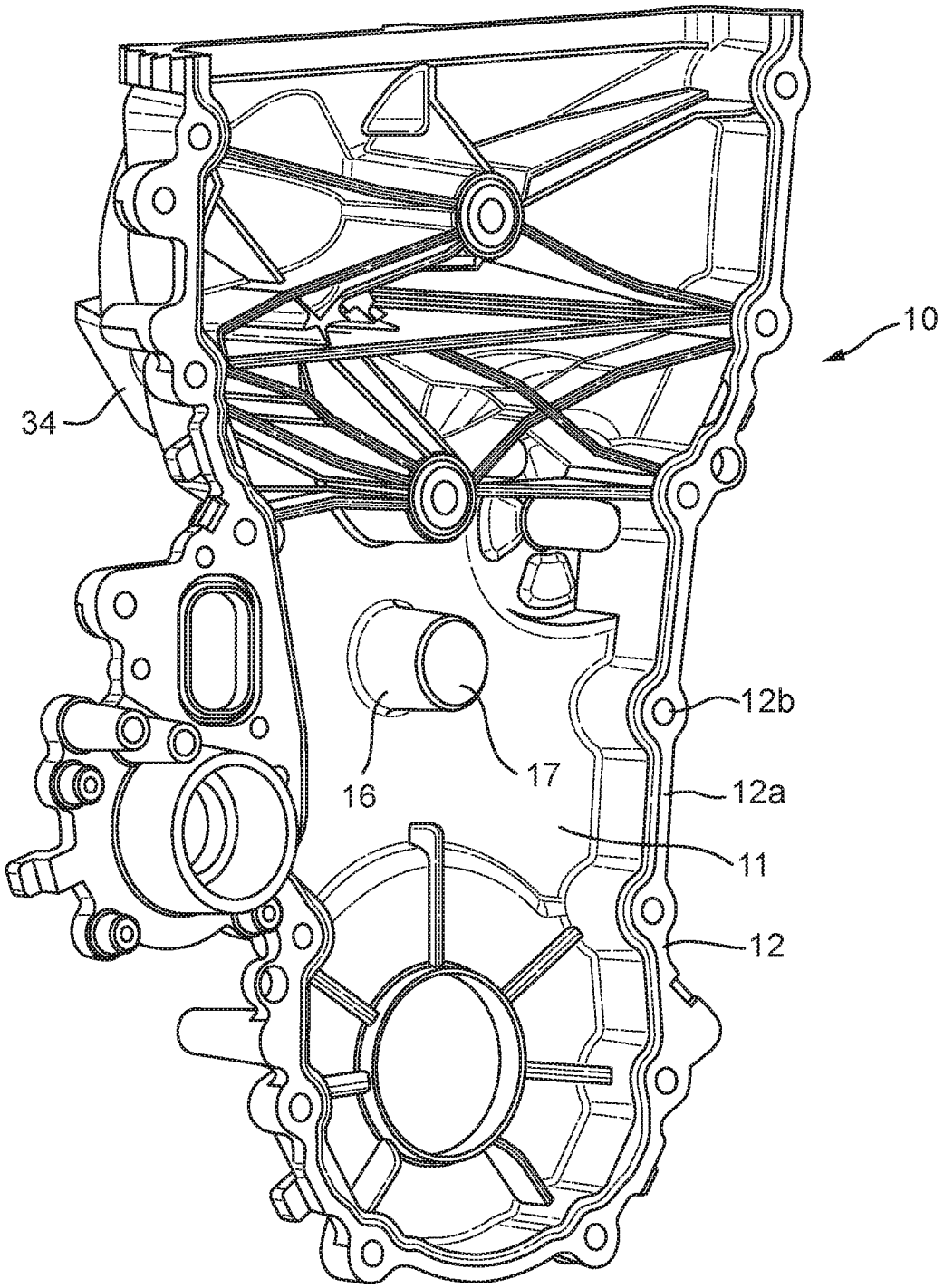
FIG. 5 is a perspective view showing the rear side of the front engine cover, according to an arrangement of the present disclosure.

With reference to FIGS. 2 and 3, the coupling and sealing region 12 and corresponding coupling and sealing region 14, may each comprise one or more sealing surfaces 12*a* and corresponding sealing surfaces 14*a* respectively. When the front cover 10 is coupled to the engine housing 4, the sealing surfaces 12*a* may mate with the corresponding sealing surfaces 14*a* to create a seal between the engine housing 4 and front cover 10.

A solid seal, such as a gasket (not shown), may be provided between the engine housing 4 and the front cover 10 to improve the sealing between the sealing surfaces 12*a*, 14*a*. Additionally or alternatively, an engine sealant such as a Room Temperature Vulcanization (RTV) sealant, e.g. an RTV silicone sealant, may be applied between the sealing surfaces 12*a*, 14*a* to improve the sealing of the cavity 8.

The coupling and sealing region 12 may further comprise one or more openings 12*b*. The corresponding coupling and sealing region 14 may comprise corresponding openings 14*b*. One or more of the corresponding openings 14*b* may comprise a threaded portion 14*c*. The front cover may be coupled to the engine housing 4 by one or more fasteners (not shown) received within the openings 12*b* and corresponding openings 14*b*. Threading the fasteners into the threaded portions 14*c* may allow the coupling and sealing region 12*a* of the engine cover 10 to be clamped against the engine housing 4, which may improve the sealing of the cavity 8.

One or more of the openings 14*b* may not comprise a threaded portion 14*c* and may be configured to receive pins or dowels (not shown). Providing the pins or dowels may prevent the sealing surfaces 12*a*, 14*a* from moving out of alignment with each other. However, the pins and dowels may not provide a clamping load between the cover 10 and the engine housing 4. The pins or dowels may be received within the openings 12*b* of the cover or may be integrally formed on the coupling and sealing region 12 of the front cover 10. Alternatively, the pins or dowels may be integrally formed on the engine housing 4.

In an alternative arrangement (not shown) the corresponding coupling region 14, may comprise one or more studs (not shown). The studs may be configured to align with the openings 12*a*. The studs may extend through the openings 12*a* when the cover 10 is coupled to the engine housing 4. The studs may comprise a threaded portion allowing a nut to be threaded onto each of the studs to provide a clamping load to clamp the cover 10 against the engine house 4. The studs may be integral with the engine housing 4. Alternatively, the studs may be permanently or temporarily, e.g. mechanically, coupled to the engine housing 4.

The sealing surfaces 12*a* and the corresponding sealing surfaces 14*a* may extend around, e.g. substantially completely surround, the openings 12*b* and or the corresponding openings 14*b* respectively, in order to create a seal between the cavity 8 and the openings 12*b* and/or corresponding openings 14*b*.

Vibrations of the engine during engine running due to, for example, combustion, component and/or acoustic resonances, and/or rotating parts may vibrate the engine housing 4 and may vibrate the cover 10. The vibrations of the engine may be at least partially caused by the movement of engine pistons (not shown) within the engine cylinders 4*a*, 4*b*, 4*c*. One or more frequencies of the vibrations may be related to the rotational speed of an engine crank shaft (not shown), which is driven by the pistons. The frequencies of the vibrations may vary during use of the engine. At a particular frequency of engine running, one or more of the frequencies of vibrations of the engine may be substantially equal to a natural frequency of a vibration mode of the cover 10. For example, the frequency of vibrations of the engine may be substantially equal to the natural frequency of a membrane mode of a planar region 11 of the cover 10. The planar region may be substantially flat or may be a curved panel. The vibrations may cause the cover 10 to resonate at the planar region 11, which may create large amplitude oscillations of one or more portions of the planar region. Vibration of the cover 10 may create undesirable noise.

Additionally, as described above, the cavity 8 may be sealed at the interface between the coupling and sealing region 12 of the cover 10 and the corresponding coupling and sealing region 14 provided on the engine housing. Oscillations of the planar region 11 of the cover 10 may cause deflections of the coupling and sealing region 12, which may reduce the effectiveness of sealing at the interface. This may lead to dust, contaminants and/or other substances entering and/or exiting the cavity 8.

In order to reduce vibrations and/or oscillations of the cover 10, the cover 10 may comprise an engine cover boss 16. The engine cover boss 16 may extend from the cover 10 towards the engine housing 4. The engine cover boss may be configured to couple to the engine housing 4. The engine cover boss 16 may be provided at a location on the cover 10 that experiences a high amplitude of vibration compared to other locations on the cover. For example, the engine cover boss 16 may be provided on the planar region 11 of the cover. The engine cover boss 16 may be spaced apart from the coupling and sealing region 12.

The location of the engine cover boss 16 may be tuned to reduce vibration of the cover. For example, the engine cover boss 16 may be provided substantially centrally within the planar region 11 of the engine cover 10. The engine cover boss 16 may be free from any additional stiffening features, e.g. the engine cover boss may not comprise any webs or ribs extending from the boss over the planar region. Additionally or alternatively, the engine cover boss may not be coupled to or integral with any webs or ribs joined to the coupling and sealing region 12 or another stiffening feature of the engine cover 10. The engine cover boss 16 may form an island within the planar region 11.

As depicted in FIG. 1, the engine cover 10 may be coupled to the engine housing using an adhesive and the engine cover boss 16 may comprise a contact surface 17 configured to receive the adhesive. The engine housing 4 may comprise a corresponding contact surface 19 configured to mate with the contact surface 17. As shown in FIG. 1, the corresponding contact surface 19 may be provided on a housing boss 18 of the engine housing 4.

The interface between the contact surface 17 and corresponding contact surface 19 may be within the cavity 8, e.g. substantially central within the cavity between the engine housing and the engine cover. The contact surface 17 and/or the corresponding contact surface 19 may be provided in substantially the same plane as the coupling and sealing region 12 and the corresponding coupling and sealing region 14 respectively.

In addition to, or instead of the adhesive, the engine cover boss 16 may comprise an opening (not shown) and the coupling boss may be coupled to the engine housing 4 by a fastener, which passes though the opening.

As depicted in FIG. 1, a damping material 20 may be provided between the engine cover boss and the engine housing. The engine cover boss 16 and damping material 20 may thereby be configured to damp the vibration of the engine cover 10.

The damping material 20 may comprise a viscoelastic material capable of adhering the engine cover boss 16 to the engine housing boss 18, and damping vibrations of the cover 10 relative to the engine housing 4. For example, the adhesive may comprise the RTV sealant.

The RTV sealant of the damping material 20 may be the same RTV sealant applied between the cover 10 and the engine housing 4, e.g. to improve the sealing at the coupling and sealing region 12. Hence, when the engine assembly is assembled, the RTV sealant may be applied to the coupling and sealing region 12 and/or the corresponding coupling and sealing region 14 and the engine cover boss 16 and/or the housing boss 18 in the same application operation.

The size, e.g. area, of the engine cover boss 16 and/or housing boss 18 contact surfaces may be configured according to an adhesive shear strength of the damping material 20.

For example, the contact surface cross-sectional area may be sized to receive sufficient adhesive to withstand the maximum anticipated vibration forces. Additionally or alternatively, the size of the engine cover boss 16 and/or housing boss 18 may be configured according to a vibration and/or damping characteristic of the damping material 20, e.g. a viscosity or elasticity of the damping material.

The engine cover boss 16 and/or housing boss 18 may be configured to allow sufficient damping material to be applied to suitably couple the engine cover boss 16 to the housing boss 18, and suitably damp vibrations of the front cover 10 relative to the engine housing 4. For example, it may be desirable to have a larger, e.g. thicker, layer of adhesive at the bosses 16, 18 than at the coupling and sealing region 12, 14. This may be achieved by providing a larger gap between the respective contact surfaces 17, 19 and applying additional adhesive.

The engine assembly 2 may further comprise a belt drive 22. The belt drive 22 may be provided within the cavity 8, e.g. the front cover 10 may at least partially surround the belt drive 22.

With reference to FIG. 2, the belt drive 22 may comprise a belt 24, a drive pulley 26 and one or more driven pulleys (not shown). The drive pulley 26 may be coupled to the crank shaft of the engine (not shown) and may be configured to drive the belt drive 22. The driven pulleys may be coupled to one or more cam shafts of the engine (not shown). The belt drive 22 may further comprise a belt tensioner 29, such as an idler gear, configured to maintain tension in the belt 24, to ensure that the belt 24 does not disengage from the pulleys 26.

The engine cover boss 16 and/or the housing boss 18 may be provided between portions of the belt 24, e.g. the bosses may be provided within the perimeter of the belt. The bosses 16, 18 may be provided near or adjacent to the belt tensioner 29.

The torque required to drive the one or more cam shafts may vary during a rotation of the crank shaft, which may vary the tensile and/or compressive forces present within the belt 24. The variation in forces in the belt may cause the belt to vibrate, e.g. in a direction perpendicular to the direction of belt travel. Additionally or alternatively, the vibration of the engine housing 4 and/or another component of the engine may affect the vibration of the belt 24. A portion of the belt that is located between the pulleys 26 may oscillate about a mean position. As depicted in FIG. 3, the extent of the belt 24 movement may define a keep-out zone 30.

In order to prevent damage to the belt, such as wear, e.g. edge wear or tooth wear, it may be desirable to ensure that no other component is provided within, or on the edge of the keep-out zone 30 of the belt.

The cover 10 may be configured to enclose at least a portion of the keep-out zone 30. At least a portion of the planar region 11 may overlap with at least a portion of the keep-out zone 30. The keep-out zone 30 may at least partially overlap with the planar region 11 at or near a location where it would be beneficial to provide the engine cover boss 16 and/or the housing boss 18 to allow the engine cover to be coupled to the engine housing to reduce the amplitude of vibration of the cover 10. The engine cover boss 16 and/or the housing boss 18 may therefore be sized, shaped and/or positioned such that the engine cover boss 16 and/or housing boss 18 is provided outside the keep-out zone 30 of the belt.

As mentioned above, the engine cover boss 16 and/or housing boss 18 may be sized according to the shear strength and/or viscosity of the damping material 20. Hence, in order to provide a suitably sized engine cover boss 16 and/or housing boss 18, the shape of the engine cover boss 16 and/or housing boss 18 may be at least partially defined by the keep-out zone 30, e.g. by following the shape of the keep-out zone. This may allow the area of the engine cover boss 16 and/or housing boss 18 to be maximized.

Although the description above refers to the belt drive 22, as shown in FIGS. 1 to 3, it is also envisaged that the present disclosure may apply to any other drive assembly, such as a chain drive or gear drive.

The engine cover 10 may further comprise an engine mount 32, configured to couple the engine assembly 2 to a chassis of a vehicle, such as a motor vehicle (not shown). As shown in FIG. 1, the engine mount 32 may be provided away from the planar region 11. The engine mount 32 may be provided on a mounting structure 34, which extends from the planar region 11 and/or the coupling and sealing region 12. The engine mount 32 may be provided away from planes defined by the planar region 11 and the coupling and sealing region 12 respectively.

One or more modes of vibration of the engine assembly 2 may correspond to a displacement of the engine assembly relative to the chassis. Additionally or alternatively, accelerations and decelerations of the vehicle may cause inertial loads on the engine assembly 2. Forces resulting from the vibration of the engine assembly 2 and/or the inertial loads on the engine may be reacted by the vehicle chassis at the engine mount 32.

Reaction forces at the engine mount 32, may lead to compressive and tensile loads, and bending moments being applied to the mounting structure 34. The mounting structure 34 may be substantially inflexible, e.g. rigid. Hence, the reaction forces and bending moments may be applied to the front cover 10. As the mounting structure 34 is provided away from the planes of the planar region 11 and coupling and sealing region 12, the compressive and tensile loads within the mounting structure 34 may induce additional bending moments in the cover 10 between the mounting structure 34 and a location on the cover which is coupled to the engine housing 4. The front cover 10 may therefore be deflected at a location between the mounting structure 34 and the engine housing 4. For example, the cover may be deflected at or near the coupling and sealing region 12.

Providing the engine cover boss 16 and/or the housing boss 18, and coupling the cover 10 to the engine housing 4, as described above, may allow for an alternative load path between the engine mount 32 and the engine housing 4. The alternative load path may lead to a reduction in the bending moments present in the cover 10 between the mounting structure 34 and the engine housing 2. Additionally, by providing an additional coupling location between the cover and the engine housing 4, the effective stiffness of the cover 10 between the mounting structure 34 and the engine housing 4 may be increased. Deflections of the front cover 10, due to loads applied through the mounting structure 34 may therefore be reduced.

Although in the arrangement described above the corresponding contact surface 19 is provided on the housing boss 18, it is equally envisage that the engine housing 4 may not comprise the housing boss 18 and the corresponding contact surface 19 may be provided on a face of the engine housing, e.g. the corresponding contact surface 19 may be provided on a wall of the cavity 8.

In another alternative arrangement (not shown), the engine cover 10 may not comprise the engine cover boss 16 and the contact surface 17 may be provided on a face of the cover. For example, the contact surface 17 may be provided on the planar region 11 of the engine cover 10. In this arrangement, the housing boss 18 may extend across the cavity 8, such that the corresponding contact surface 19 is provided adjacent to the contact surface 17, e.g. the housing boss may extent across the cavity 8 to contact the planar region 11 of the engine cover.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be appreciated by those skilled in the art that although the disclosure has been described by way of example, with reference to one or more examples, it is not limited to the disclosed examples and alternative examples may be constructed without departing from the scope of the disclosure as defined by the appended claims.

The invention claimed is:

1. An engine assembly comprising an engine cover configured to cover a portion of an engine housing, wherein the engine cover comprises:

a coupling region provided around a periphery of at least a portion of the engine cover, the coupling region configured to mate with a corresponding coupling region on the engine housing so as to form a seal between the engine cover and the engine housing;

a first engine cover boss provided substantially centrally on a planar region of the engine cover and spaced apart from the coupling region, the first engine cover boss comprising a contact surface configured to receive an adhesive to couple the engine cover to a corresponding contact surface of the engine housing, with the first engine cover boss open at the planar region and closed at the contact surface and not comprising any webs or ribs extending from the first engine cover boss over the planar region; and a second engine cover boss provided on the planar region and coupled to a plurality of webs extending from the second engine cover boss, the second engine cover boss positioned further apart from an opening adapted to encircle a drive pulley of a drive assembly of the engine assembly than the first engine cover boss, where the drive pulley is coupled to a crank shaft of the engine assembly and the drive assembly forms a keep-out zone;

wherein each of the first engine cover boss and the second engine cover boss is positioned outside of the keep-out zone and encircled by the drive assembly;

wherein the engine cover further comprises an engine mount spaced apart from the planar region of the engine cover, the engine mount adapted to couple the engine assembly to a chassis of a vehicle; and wherein the coupling between the engine cover and the engine housing at the contact surface is configured to increase a rigidity of the engine cover between the engine mount and the engine housing.

2. The engine assembly of claim 1, further comprising the engine housing.

3. The engine assembly of claim 2, wherein the engine housing further comprises a housing boss, and wherein the corresponding contact surface of the engine housing is provided on the housing boss.

4. The engine assembly of claim 1, wherein the engine housing further comprises a housing boss, and wherein the corresponding contact surface of the engine housing is provided on the housing boss.

5. The engine assembly of claim 4, wherein the coupling between the engine cover and the engine housing at the contact surface is configured to damp a vibration mode of the engine cover.

6. The engine assembly of claim 4, wherein the engine cover is configured to at least partially surround the drive assembly; and wherein a shape and/or position of the first engine cover boss is configured such that the first engine cover boss is provided outside the keep-out zone of the drive assembly, with the planar region overlapping at least a portion of the keep-out zone.

7. The engine assembly of claim 1, wherein the engine cover is configured to at least partially surround the drive assembly; and wherein a shape and/or position of the first engine cover boss is configured such that the first engine cover boss is provided outside the keep-out zone of the drive assembly, with the planar region overlapping at least a portion of the keep-out zone.

8. The engine assembly of claim 7, wherein the shape of at least part of the first engine cover boss follows a shape of the keep-out zone.

9. The engine assembly of claim 1, wherein the adhesive comprises an engine sealant.

10. The engine assembly of claim 9, wherein the engine sealant is applied to the coupling region or corresponding coupling region to seal between the engine housing and the engine cover.

11. The engine assembly of claim 1, wherein the engine cover is a front engine cover.

12. The engine assembly of claim 1, wherein the engine housing comprises an engine cylinder head and/or an engine cylinder block.

13. The engine assembly of claim 1, wherein the coupling between the engine cover and the engine housing at the contact surface is configured to improve a noise, vibration and/or harshness characteristic of the engine cover.

14. An engine assembly comprising an engine cover and an engine housing configured to be partially covered by the engine cover, wherein the engine housing comprises:

a coupling region configured to mate with a corresponding coupling region provided around a periphery of at least a portion of the engine cover; and a housing boss spaced apart from the coupling region, wherein the housing boss comprises a contact surface configured to receive an adhesive to couple the engine housing to a corresponding contact surface on a planar region of the engine cover, the housing boss extending across a cavity formed between a cylinder block of the engine assembly and the engine cover to contact the corresponding contact surface on the planar region, the planar region positioned to overlap at least a portion of a keep-out zone of a drive assembly of the engine assembly;

wherein the engine cover comprises an engine mount spaced apart from the planar region of the engine cover, the engine mount positioned away from a plane of the planar region and a plane of the coupling region, the engine mount adapted to couple the engine assembly to a chassis of a vehicle; and wherein the coupling between the engine cover and the engine housing at the contact surface is configured to increase a rigidity of the engine cover between the engine mount and the engine housing.

15. The engine assembly of claim 14, wherein the coupling between the engine cover and the engine housing at the contact surface is configured to damp a vibration mode of the engine cover.

16. The engine assembly of claim 14, wherein the engine cover is configured to at least partially surround the drive assembly; and wherein a shape and/or position of the housing boss is configured such that the housing boss is provided outside the keep-out zone of the drive assembly.

17. The engine assembly of claim 16, wherein the shape of at least part of the housing boss follows a shape of the keep-out zone.

18. A method of assembling an engine assembly, the method comprising:

providing an engine housing;

providing an engine cover configured to cover a portion of the engine housing, wherein the engine cover comprises:

a coupling region provided around a periphery of at least a portion of the engine cover, the coupling region configured to mate with a corresponding coupling region on the engine housing so as to form a seal between the engine cover and the engine housing;

a first engine cover boss provided substantially centrally on a planar region of the engine cover and spaced apart from the coupling region, the engine cover boss comprising a contact surface configured to receive an adhesive to couple the engine cover to a corresponding contact surface of the engine housing, with the first engine cover boss open at the planar region and closed at the contact surface and not comprising any webs or ribs extending from the first engine cover boss over the planar region;

a second engine cover boss provided on the planar region and coupled to a plurality of webs extending from the second engine cover boss, the second engine cover boss positioned further apart from an opening adapted to encircle a drive pulley of a drive assembly of the engine assembly than the first engine cover boss, where the drive pulley is coupled to a crank shaft of the engine assembly and the drive assembly forms a keep-out zone, wherein each of the first engine cover boss and the second engine cover boss is positioned outside of the keep-out zone and encircled by the drive assembly; and an engine mount spaced apart from the planar region of the engine cover, the engine mount positioned away from a plane of the planar region and a plane of the coupling region, the engine mount adapted to couple the engine assembly to a chassis of a vehicle;

applying the adhesive to the contact surface or corresponding contact surface; and coupling the engine cover to the engine housing using the adhesive, wherein the coupling between the engine cover and the engine housing at the contact surface is configured to increase a rigidity of the engine cover between the engine mount and the engine housing.

* * * * *